US012091855B1

(12) United States Patent
Woodland et al.

(10) Patent No.: US 12,091,855 B1
(45) Date of Patent: Sep. 17, 2024

(54) INSULATED TILT-UP WALL PANEL

(71) Applicants: Jason McSpadden Woodland, Pocatello, ID (US); Robert Dean Elzner, Pocatello, ID (US)

(72) Inventors: Jason McSpadden Woodland, Pocatello, ID (US); Robert Dean Elzner, Pocatello, ID (US)

( * ) Notice: Subject to any disclaimer, the term of this patent is extended or adjusted under 35 U.S.C. 154(b) by 0 days.

(21) Appl. No.: 17/094,415

(22) Filed: Nov. 10, 2020

(51) Int. Cl.
*E04C 2/288* (2006.01)
*E04B 2/86* (2006.01)
*E04C 1/41* (2006.01)

(52) U.S. Cl.
CPC ..... *E04C 2/288* (2013.01); *E04B 2/86* (2013.01); *E04C 1/41* (2013.01)

(58) Field of Classification Search
CPC ..... E04C 2/288; E04C 1/41; E04B 2/86
See application file for complete search history.

(56) References Cited

U.S. PATENT DOCUMENTS 3,775,916 A * 12/1973 Bair ..... E04C 2/284 52/125.4
5,129,203 A * 7/1992 Romero ..... E04C 2/205 52/309.14
5,224,315 A * 7/1993 Winter, IV ..... E04B 1/6183 428/218
5,373,674 A * 12/1994 Winter, IV ..... E04C 2/288 52/309.9
5,596,853 A * 1/1997 Blaney ..... E04C 2/044 52/223.7
5,758,463 A * 6/1998 Mancini, Jr. ..... E04C 2/384 52/309.7
6,164,035 A * 12/2000 Roberts ..... E04B 2/24 52/745.1
6,701,683 B2 * 3/2004 Messenger ..... E04C 2/049 52/794.1
6,729,090 B2 * 5/2004 Messenger ..... E04C 2/049 52/794.1
6,898,908 B2 * 5/2005 Messenger ..... E04C 2/044 52/406.1
8,555,584 B2 * 10/2013 Ciuperca ..... E04C 2/06 52/309.7
8,844,227 B1 * 9/2014 Ciuperca ..... E04C 2/288 52/309.11
9,103,119 B2 * 8/2015 Foderberg ..... E04C 2/34
9,580,913 B2 * 2/2017 Le Madec ..... E04B 5/36
9,938,719 B2 * 4/2018 Derleth ..... E04B 5/48
9,970,192 B2 * 5/2018 Ravellette ..... F24S 10/00
11,293,179 B2 * 4/2022 Heath ..... B29C 64/106
(Continued)

*Primary Examiner* — Rodney Mintz
(74) *Attorney, Agent, or Firm* — Bryant J. Keller; Kirton McConkie

(57) ABSTRACT

A tilt-up wall panel formed on a horizontal support surface within a form comprises an outer foam layer having a top surface, and an outer surface with an outer finish layer applied thereto. An intermediate concrete layer having a bottom surface and a top surface is applied, at the bottom surface thereof, to the top surface of the outer foam layer. An intermediate foam layer having a bottom surface and a top surface is applied, at the bottom surface thereof, to the top surface of the intermediate concrete layer. A concrete inner layer having a bottom surface and a top surface is applied, at the bottom surface thereof, to the top surface of the intermediate foam layer. The tilt-up wall panel is then raised to a vertical position to form part of a wall of a building. Methods of forming the tilt-up wall panel are disclosed.

19 Claims, 3 Drawing Sheets

(56) References Cited

U.S. PATENT DOCUMENTS

2003/0167715 A1* 9/2003 Messenger ..... E04C 2/044 52/309.14
2003/0167716 A1* 9/2003 Messenger ..... E04C 2/044 52/309.12
2004/0065034 A1* 4/2004 Messenger ..... E04C 2/2885 52/309.11
2008/0115442 A1* 5/2008 Cheng ..... B32B 13/02 52/745.13
2012/0058299 A1* 3/2012 Serwin ..... E04C 2/288 428/161
2013/0074433 A1* 3/2013 Ciuperca ..... E04B 1/41 52/698
2014/0087158 A1* 3/2014 Ciuperca ..... B32B 3/266 428/223
2014/0260034 A1* 9/2014 Ciuperca ..... E04C 5/125 52/405.3
2015/0076726 A1* 3/2015 Mathieu ..... B29C 44/02 264/51
2015/0079356 A1* 3/2015 Mathieu ..... E04C 2/049 428/192
2015/0167303 A1* 6/2015 Foderberg ..... E04C 5/162 52/703
2016/0076257 A1* 3/2016 Le Madec ..... E04B 5/36 428/167
2016/0222651 A1* 8/2016 MacKinlay ..... E04C 2/288
2017/0275873 A1* 9/2017 Ravellette ..... E04C 2/46
2018/0073248 A1* 3/2018 Derleth ..... E04B 1/541
2019/0256421 A1* 8/2019 Daubresse ..... C04B 28/12
2021/0108412 A1* 4/2021 Heath ..... E04C 2/049
2021/0230865 A1* 7/2021 Fisler ..... E04C 2/288
2021/0301527 A1* 9/2021 Dombowsky ..... B28B 19/0015
2022/0136236 A1* 5/2022 O'Meara ..... B32B 5/024 52/232
2022/0195724 A1* 6/2022 Theberge ..... E04B 1/942

* cited by examiner

INSULATED TILT-UP WALL PANEL

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to building materials, and more particularly to an insulated tilt-up wall panel.

BACKGROUND

Tilt-up concrete wall panels are well known in the art and comprise a large percentage of industrial, warehouse, and other buildings. Concrete, however, is relatively dense and as n such has a relatively high thermal and sound transmission rate. For example, concrete formed with a sand and gravel aggregate has an R-Value of 0.13-0.64. Polystyrene foam boards, on the other hand, have R-Values of between 3.6 and 5.4. Yet polystyrene foam by itself is not nearly strong enough to be used as a wall panel for a building.

Therefore, there is a need for a tilt-up wall panel that has the strength of concrete but insulating and sound absorbing qualities that are similar to polystyrene. Such a needed invention would allow for a plurality of different outer finish layers to provide a variety of finished appearances. Such a needed wall panel would be relatively inexpensive, and would require a process similar to that of concrete tilt-up panels to lift and affix to a building structure. The present invention accomplishes these objectives.

SUMMARY OF THE INVENTION

The present device is a tilt-up wall panel formed on a horizontal support surface within a form. Such a horizontal support surface may be a smooth concrete slab prepared to be a casting surface for the tilt-up wall panel, for example, and may later be used as a floor of a building formed with a plurality of the tilt-up wall panels.

The tilt-up wall panel comprises an outer foam layer having a top surface, and an outer surface with an outer finish layer applied thereto. Such an outer finish layer may include stucco, brick facia, stone, vinyl-style siding, or other surface treatments as desired.

An intermediate concrete layer having a bottom surface and a top surface is applied, at the bottom surface thereof, to the top surface of the outer foam layer. An intermediate foam layer having a bottom surface and a top surface is applied, at the bottom surface thereof, to the top surface of the intermediate concrete layer. A concrete inner layer having a bottom surface and a top surface is applied, at the bottom surface thereof, to the top surface of the intermediate foam layer. When the tilt-up wall panel is raised to a vertical position, the top surface of the inner layer defines an inside surface of the tilt-up wall panel that is exposed to an interior portion of the building.

Steps required for forming the tilt-up wall panel include first providing the horizontal support surface suitable for use as a casting surface for concrete. The outer foam layer is in laid onto the support surface within the form, and then the intermediate concrete layer is poured into the form onto the top surface of the outer foam layer. Then, before the intermediate concrete layer cures, the intermediate foam layer is applied to the top surface of the intermediate concrete layer. Then, either immediately or sometime later, the concrete inner layer is poured over the top surface of the intermediate foam layer. When the concrete inner layer cures, the tilt-up wall panel may be raised up to a vertical position to form part of a building structure, as is known in the art.

In an alternate method of forming the tilt-up wall panel, the concrete inner layer is formed first, poured onto the horizontal support surface within the form. In such an embodiment a release agent may be applied to the horizontal support surface first, so that the concrete of the concrete inner layer is inhibited from bonding to the horizontal support surface, as is known in the art. Before the concrete inner layer cures, the intermediate foam layer is applied to the bottom surface of the concrete inner layer. Then, either immediately or sometime later, the intermediate concrete layer is poured onto the bottom surface of the intermediate foam layer, and the outer foam layer is applied to the bottom surface of the intermediate concrete layer. When the intermediate concrete layer cures, the tilt-up wall panel may be raised up to a vertical position to form part of a building structure, as is known in the art.

The present invention is a tilt-up wall panel that has the strength of concrete but insulating and sound absorbing qualities that are closer to polystyrene. The present invention allows for a plurality of different outer finish layers to provide a variety of finished appearances. The present wall panel is further relatively inexpensive, and requires a process similar to that of concrete tilt-up panels to tilt-up and affix to a building structure. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
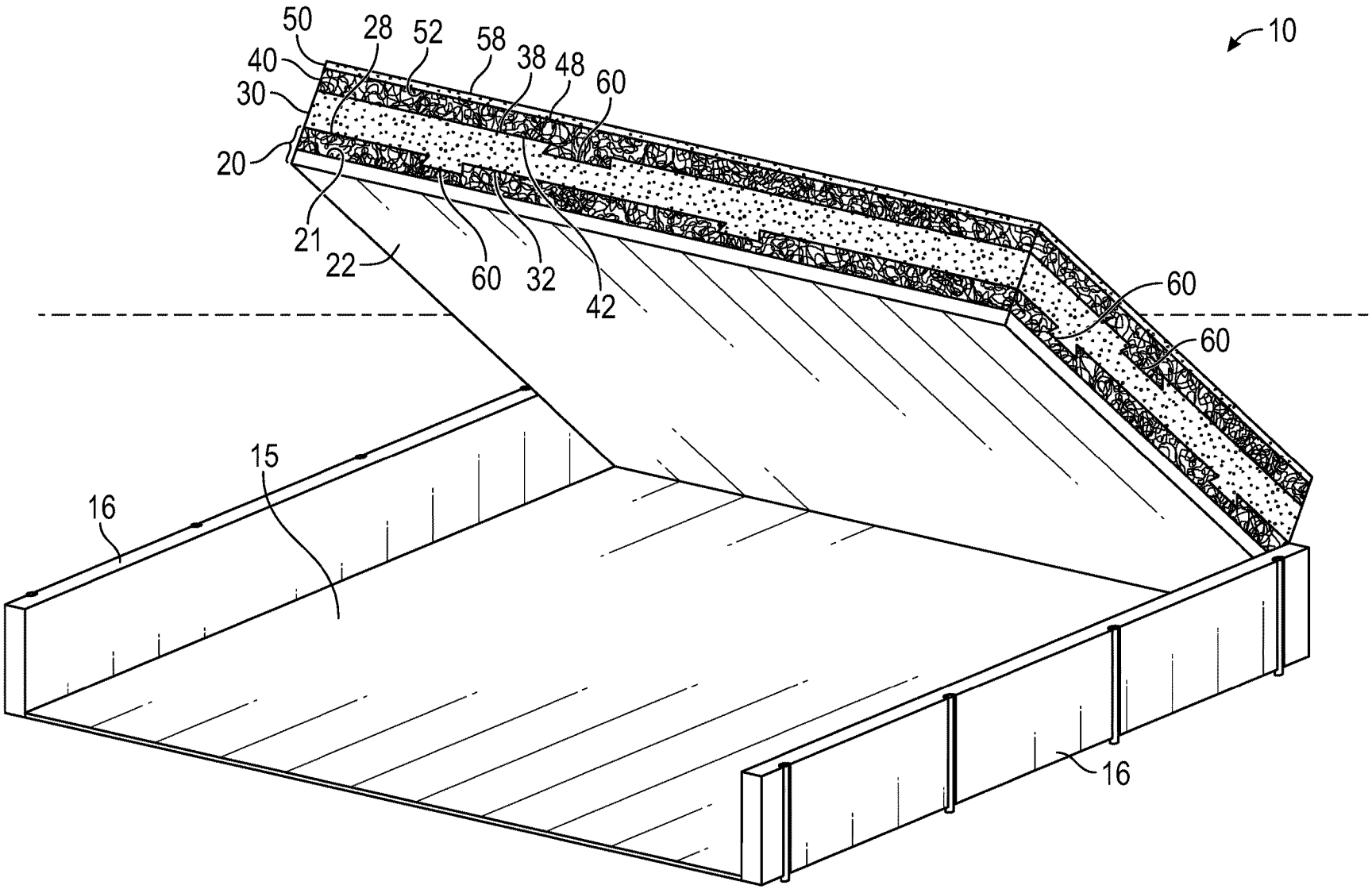
FIG. 1 is a perspective view of a tilt-up wall panel of the present invention.
Figure 2:
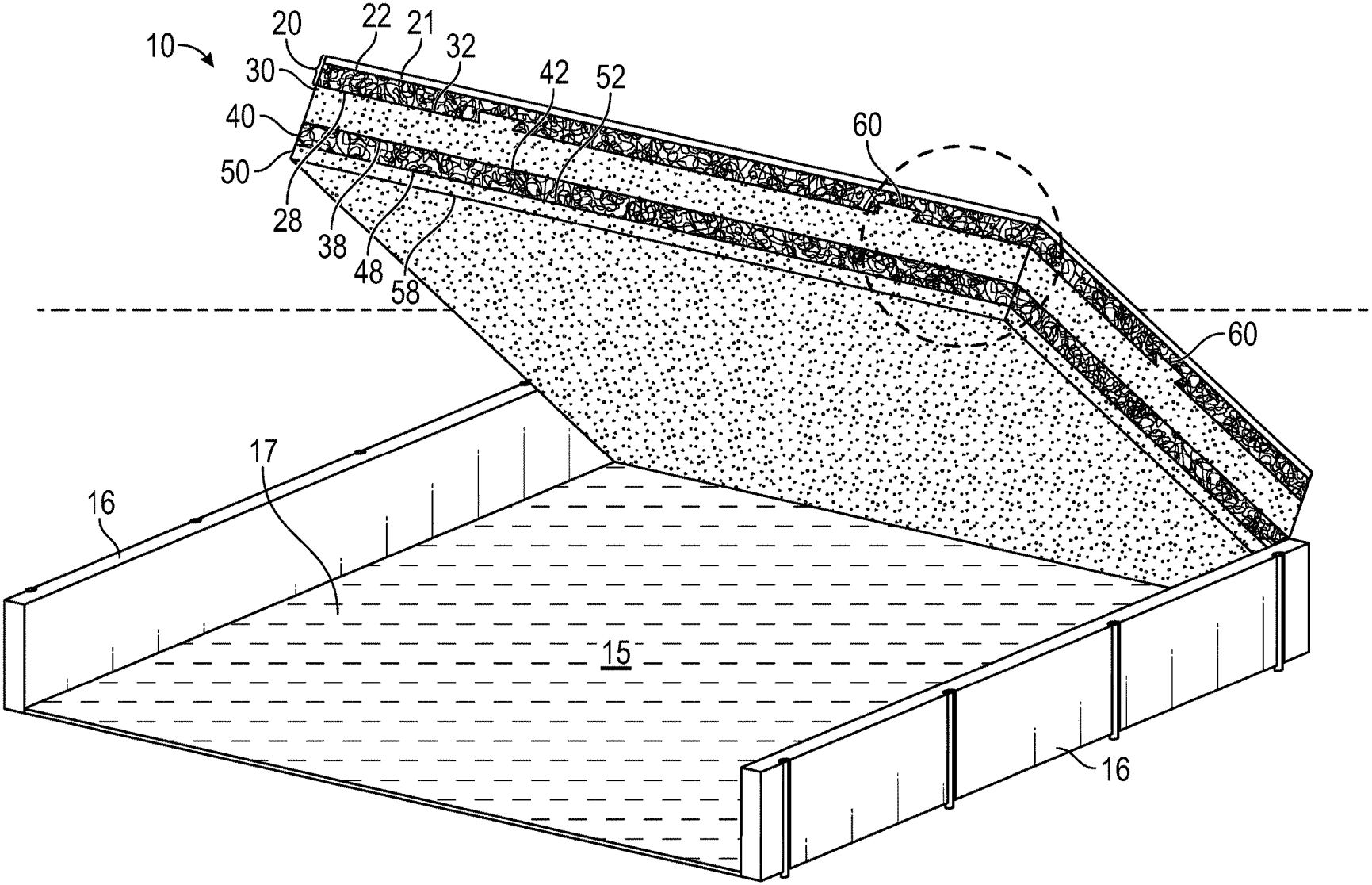
FIG. 2 is a perspective view of an alternate tilt-up wall panel.
Figure 3:
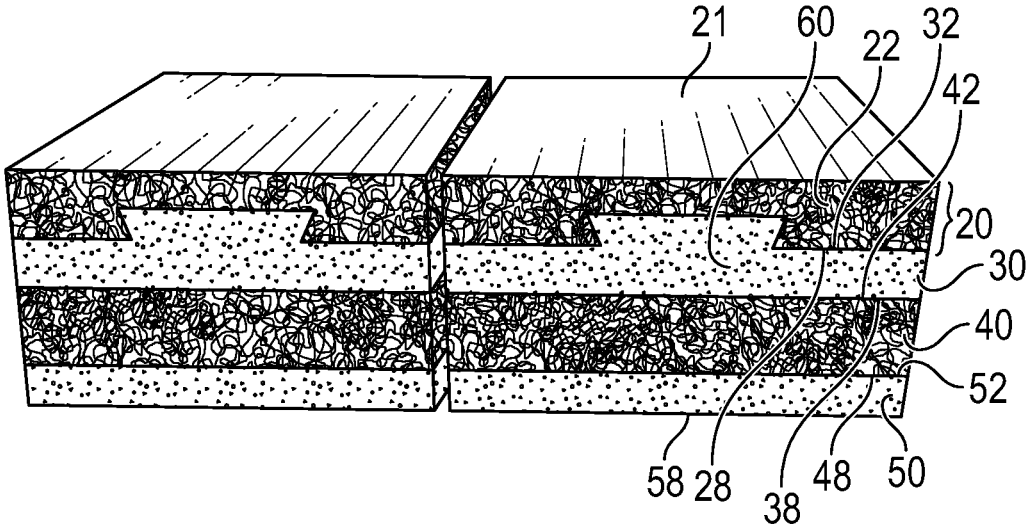
FIG. 3 is a partial, enlarged view of an edge of the wall panel of FIG. 2.
Figure 4:
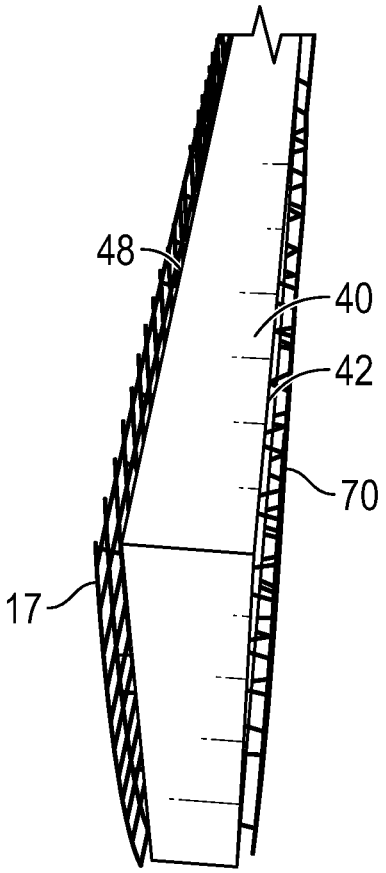
FIG. 4 is a perspective view of an intermediate foam laying having wire mesh elements on both top and bottom sides thereof.

FIGS. 1-3 illustrate a tilt-up wall panel 10 formed on a horizontal support surface 15 within a form 16. Such a horizontal support surface may be a smooth concrete slab prepared to be a casting surface for the tilt-up wall panel 10, for example, and may later be used as a floor of a building (not shown) formed with a plurality of the tilt-up wall panels 10.

The tilt-up wall panel 10 comprises an outer foam layer 20 having a top surface 28, and an outer surface 22 with an outer finish layer 21 applied thereto. Such an outer finish layer 21 may include stucco, brick facia, stone, vinyl-style siding, or other surface treatments as desired. When the tilt-up wall panel 10 is lifted away from the horizontal support surface 15 and properly placed, it is intended that the outer finish layer 21 is visible from outside of the building (not shown). Various styles and materials can be used for the outer finish layer 21. The outer foam layer 20 is preferably made with a polystyrene or similar foam material having a relatively high R-Value for providing excellent insulation.

An intermediate concrete layer 30 having a bottom surface 32 and a top surface 38 is applied, at the bottom surface 32 thereof, to the top surface 28 of the outer foam layer 20. The intermediate concrete layer 30 is preferably made with an aggregate concrete that includes pebbles or sand, as is known in the art.

An intermediate foam layer 40 having a bottom surface 42 and a top surface 48 is applied, at the bottom surface 42 thereof, to the top surface 38 of the intermediate concrete layer 30. The intermediate foam layer 40 is preferably made with a polystyrene or similar foam material having a relatively high R-Value for providing excellent insulation.

A concrete inner layer 50 having a bottom surface 52 and a top surface 58 is applied, at the bottom surface 52 thereof, to the top surface 48 of the intermediate foam layer 40. When the tilt-up wall panel 10 is raised to a vertical position, the top surface 58 of the inner layer 50 defines an inside surface 58 of the tilt-up wall panel 10 that is exposed to an interior portion of the building (not shown). The concrete inner layer 50 is preferably made with an aggregate concrete that includes pebbles or sand, as is known in the art.

Steps required for forming the tilt-up wall panel 10 include first providing the horizontal support surface 15 suitable for use as a casting surface for concrete (FIG. 1). The outer foam layer 20 is laid onto the support surface 15 within the form 16, and then the intermediate concrete layer 30 is poured into the form onto the top surface 28 of the outer foam layer 20. Then, before the intermediate concrete layer 30 cures, the intermediate foam layer 40 is applied to the top surface 38 of the intermediate concrete layer 30. Then, either immediately or some time later, the concrete inner layer 50 is poured over the top surface 48 of the intermediate foam layer 40. When the concrete inner layer 50 cures, the tilt-up wall panel 10 may be raised up to a vertical position to form part of a building structure, as is known in the art.

In an alternate method of forming the tilt-up wall panel 10, the concrete inner layer 50 is formed first, poured onto the horizontal support surface within the form 16. In such an embodiment a release agent 17 (FIG. 2) may be applied to the horizontal support surface 15 first, so that the concrete of the concrete inner layer 50 is inhibited from bonding to the horizontal support surface 15, as is known in the art. Before the concrete inner layer 50 cures, the intermediate foam layer 40 is applied to the bottom surface 52 of the concrete inner layer 50. Then, either immediately or sometime later, the intermediate concrete layer 30 is poured onto the bottom surface 42 of the intermediate foam layer 40, and the outer foam layer 20 is applied to the bottom surface 32 of the intermediate concrete layer 30. When the intermediate concrete layer 30 cures, the tilt-up wall panel 10 may be raised up to a vertical position to form part of a building structure, as is known in the art.

In some embodiments the outer foam layer 20 includes a keyed recess 60 into which concrete of the intermediate concrete layer 30 flows. Once cured the outer foam layer 20 is fixed or locked with the intermediate concrete layer 30. In a similar manner the keyed recess 60 may be formed into either side of the intermediate foam layer 40 to lock the intermediate foam layer 40 to either the intermediate concrete layer 30 or the concrete inner layer 50.

In some embodiments, a malleable wire mesh 70 is fixed with the bottom surface 42 of the intermediate foam layer 40, the top surface 48 of the intermediate foam layer 40, or both, such that either the intermediate concrete layer 30 or the concrete inner layer 50, or both, are locked together with the intermediate foam layer 40. Similarly, the wire mesh 70 can be fixed with the top surface 28 of the outer foam layer 20 to lock the outer foam layer 20 to the intermediate concrete layer 30.

While a particular form of the invention has been illustrated and described, it will be apparent that various modifications can be made without departing from the spirit and scope of the invention. For example, additional layers of foam or concrete may be utilized. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above.

The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A tilt-up wall panel comprising, in order:
a first foam layer comprising:
a first surface of the first foam layer; and
an opposing second surface of the first foam layer;
a first concrete layer comprising:
a first surface of the first concrete layer; and
an opposing second surface of the first concrete layer;
a second foam layer comprising:
a first surface of the second foam layer, the first surface of the second foam layer being disposed adjacent to the second surface of the first concrete layer; and
an opposing second surface of the second foam layer,
wherein the second surface of the first foam layer is disposed adjacent to the first surface of the first concrete layer,
wherein at least one of the first foam layer and the first concrete layer defines a first keyed recess having an opening and a base,
wherein a diameter of the base is longer than a diameter of the opening, and
wherein another of the at least one of the first foam layer and the first concrete layer comprises a protrusion that extends into the first keyed recess, the protrusion being configured to resist the first concrete layer separating from the first foam layer.

2. The tilt-up wall panel of claim 1, further comprising a second concrete layer comprising:
a first surface of the second concrete layer, the first surface of the second concrete layer being disposed adjacent to the second surface of the second foam layer; and
an opposing second surface of the second concrete layer.

3. The tilt-up wall panel of claim 1, wherein at least one of the second foam layer and the first concrete layer comprises:
a second keyed recess having a second opening and a second base, wherein the second base has a second diameter that is greater than a second diameter of the second opening, and
wherein another of the at least one of the second foam layer and the first concrete layer comprises a second protrusion that extends into the second keyed recess, the second protrusion being configured to resist the first concrete layer separating from the second foam layer.

4. The tilt-up wall panel of claim 1, further comprising a wire mesh fixed to the first surface of the second foam layer at mesh points that project from the first surface of the second foam layer by a distance defining a gap, wherein the wire mesh is embedded within the first concrete layer such that a portion of the first concrete layer is disposed within the gap, thereby resisting the first concrete layer separating from the second foam layer.

5. The tilt-up wall panel of claim 1, wherein the first foam layer comprises polystyrene.

6. The tilt-up wall panel of claim 1, wherein the first foam layer defines the first keyed recess, and wherein the first concrete layer comprises the protrusion.

7. The tilt-up wall panel of claim 1, further comprising a finish layer applied to the first surface of the first foam layer.

8. The tilt-up wall panel of claim 7, wherein the finish layer comprises a material selected from the group consisting of stucco, brick fascia, stone, and vinyl siding.

9. The tilt-up wall panel of claim 8, wherein the finish layer comprises stucco.

10. A tilt-up wall panel comprising, in order:
a first foam layer comprising:
a first surface of the first foam layer, the first surface of the first foam layer having a finish layer applied thereto; and
an opposing second surface of the first foam layer;
a first concrete layer comprising:
a first surface of the first concrete layer that is disposed adjacent to the second surface of the first foam layer; and
an opposing second surface of the first concrete layer;
a second foam layer comprising:
a first surface of the second foam layer that is disposed adjacent to the second surface of the first concrete layer; and
an opposing second surface of the second foam layer; and
a second concrete layer comprising:
a first surface of the second concrete layer that is disposed adjacent to the second surface of the second foam layer; and
an opposing second surface of the second concrete layer,
wherein the first foam layer defines a first keyed recess having an opening disposed at the second surface of the first foam layer and a base disposed in an interior of the first foam layer, wherein a diameter of the base is greater than a diameter of the opening, and
wherein the first concrete layer has a protrusion that extends into the first keyed recess configured to resist the first concrete layer separating from the first foam layer.

11. The tilt-up wall panel of claim 1, wherein the first concrete layer defines a second keyed recess, and wherein the second foam layer has a second protrusion that extends into the second keyed recess configured to resist the first concrete layer separating from the second foam layer.

12. The tilt-up wall panel of claim 1, wherein the second foam layer defines a second keyed recess, and wherein the first concrete layer has a second protrusion that extends into the second keyed recess configured to resist the first concrete layer separating from the second foam layer.

13. The tilt-up wall panel of claim 1, further comprising a wire mesh fixed to the second surface of the second foam layer at mesh points that project from the second surface of the second foam layer by a distance defining a gap, wherein the wire mesh is embedded within the second concrete layer such that a portion of the second concrete layer is disposed within the gap, thereby resisting the second concrete layer separating from the second foam layer.

14. The tilt-up wall panel of claim 1, further comprising a wire mesh fixed to the second surface of the first foam layer at mesh points that project from the second surface of the first foam layer by a distance defining a gap, wherein the wire mesh is embedded within the first concrete layer such that a portion of the first concrete layer is disposed within the gap, thereby resisting the first concrete layer separating from the first foam layer.

15. The tilt-up wall panel of claim 1, further comprising a wire mesh fixed to the first surface of the second foam layer at mesh points that project from the first surface of the second foam layer by a distance defining a gap, wherein the wire mesh is embedded within the first concrete layer such that a portion of the first concrete layer is disposed within the gap, thereby resisting the first concrete layer separating from the second foam layer.

16. The tilt-up wall panel of claim 15, wherein the wire mesh is a first wire mesh and further comprising a second wire mesh fixed to the second surface of the second foam layer at second mesh points that project from the second surface of the second foam layer by a second distance defining a second gap, wherein the second wire mesh is embedded within the second concrete layer such that a portion of the second concrete layer is disposed within the second gap, thereby resisting the second concrete layer separating from the second foam layer.

17. A tilt-up wall panel comprising, in order:

a first foam layer comprising:

a first surface of the first foam layer, the first surface of the first foam layer having a finish layer applied thereto; and an opposing second surface of the first foam layer;

a first concrete layer comprising:

a first surface of the first concrete layer that is disposed adjacent to the second surface of the first foam layer; and an opposing second surface of the first concrete layer;

a second foam layer comprising:

a first surface of the second foam layer that is disposed adjacent to the second surface of the first concrete layer;

an opposing second surface of the second foam layer; and a wire mesh fixed to the first surface of the second foam layer at mesh points that project from the first surface of the second foam layer by a distance defining a gap, wherein the wire mesh is embedded within the first concrete layer such that a portion of the first concrete layer is disposed within the gap, thereby resisting the first concrete layer separating from the second foam layer; and a second concrete layer comprising:

a first surface of the second concrete layer that is disposed adjacent to the second surface of the second foam layer; and an opposing second surface of the second concrete layer.

18. The tilt-up wall panel of claim 17, wherein the first foam layer defines a keyed recess having an opening disposed at the second surface of the first foam layer and a base disposed in an interior of the first foam layer, wherein a diameter of the base is longer than a diameter of the opening, and wherein the first concrete layer has a protrusion that extends into the keyed recess configured to resist the first concrete layer separating from the first foam layer.

19. The tilt-up wall panel of claim 17, wherein the first concrete layer defines a keyed recess having an opening disposed at the second surface of the first concrete layer and a base disposed in an interior of the first concrete layer, wherein the base has a diameter that is greater than a diameter of the opening, and wherein the second foam layer has a protrusion that extends into the keyed recess configured to resist the first concrete layer separating from the second foam layer.

* * * * *